US011114293B2

(12) United States Patent
Remes et al.

(10) Patent No.: US 11,114,293 B2
(45) Date of Patent: Sep. 7, 2021

(54) SPACE-TIME BUFFER FOR ION PROCESSING PIPELINES

(71) Applicant: Thermo Finnigan LLC, San Jose, CA (US)

(72) Inventors: Philip M. Remes, Livermore, CA (US); Michael W. Senko, Sunnyvale, CA (US)

(73) Assignee: THERMO FINNIGAN LLC, San Jose, CA (US)

( * ) Notice: Subject to any disclaimer, the term of this patent is extended or adjusted under 35 U.S.C. 154(b) by 0 days.

(21) Appl. No.: 16/711,263

(22) Filed: Dec. 11, 2019

(65) Prior Publication Data

US 2021/0183639 A1 Jun. 17, 2021

(51) Int. Cl.
*H01J 49/42* (2006.01)
*H01J 49/00* (2006.01)

(52) U.S. Cl.
CPC ..... *H01J 49/4225* (2013.01); *H01J 49/009* (2013.01); *H01J 49/427* (2013.01); *H01J 49/4265* (2013.01)

(58) Field of Classification Search
CPC .. H01J 49/009; H01J 49/4225; H01J 49/4235; H01J 49/426; H01J 49/4265; H01J 49/427
See application file for complete search history.

(56) References Cited

U.S. PATENT DOCUMENTS 5,206,506 A 4/1993 Kirchner
6,794,642 B2 9/2004 Bateman et al.
7,071,467 B2 * 7/2006 Bateman ..... H01J 49/4225 250/292
7,847,243 B2 12/2010 Makarov et al.
7,858,926 B1 * 12/2010 Whitehouse ..... H01J 49/4225 250/281
9,595,432 B2 3/2017 Giles et al.
9,683,964 B2 6/2017 Park et al.
2011/0284738 A1 * 11/2011 Berg ..... H01J 49/4295 250/283

(Continued)

FOREIGN PATENT DOCUMENTS

DE 19930894 A1 1/2001
EP 3054473 A1 8/2016

(Continued)

OTHER PUBLICATIONS

March, R. E. (2012), "Quadrupole Ion Trap Mass Spectrometer", Update based on the original article by Raymond March, Encyclopedia of Analytical Chemistry, © 2000, John Wiley & Sons, Ltd., In Encyclopedia of Analytical Chemistry (eds R. A. Meyers and R. A. Meyers). doi:10.1002/9780470027318.a6015.pub2.

*Primary Examiner* — David E Smith
(74) *Attorney, Agent, or Firm* — David A. Schell

(57) ABSTRACT

A space-time buffer includes a plurality of discrete trapping regions and a controller. The plurality of discrete trapping regions is configured to trap ions as individual trapping regions or as combinations of trapping regions. The controller is configured to combine at least a portion of the plurality of trapping regions into a larger trap region; fill the larger trap region with a plurality of ions; split the larger trap region into individual trapping regions each containing a portion of the plurality of ions; and eject ions from the trapping regions.

14 Claims, 9 Drawing Sheets

(56) References Cited

U.S. PATENT DOCUMENTS

Figure 1:
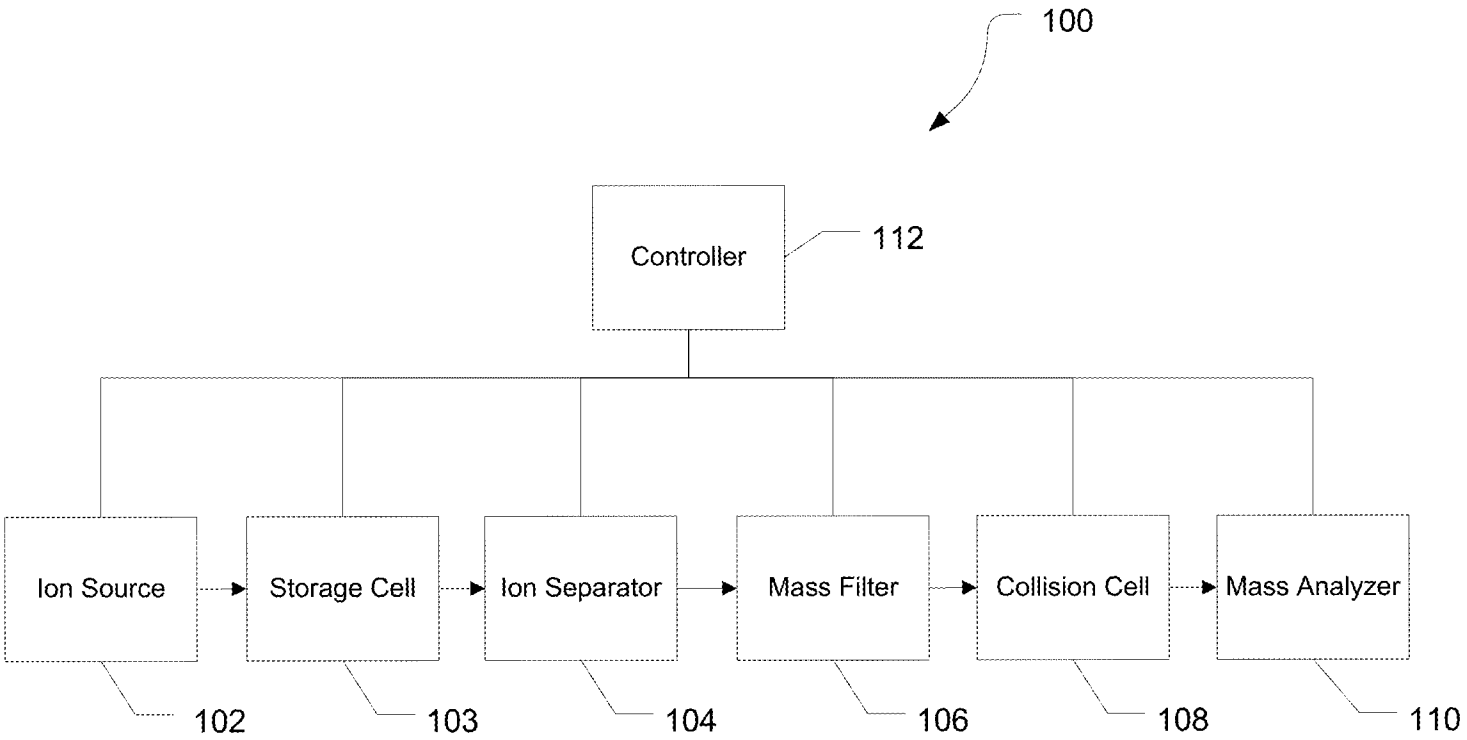

| | | | | |
|---|---|---|---|---|
| 2012/0256083 | A1* | 10/2012 | Kovtoun | H01J 49/06 250/282 |
| 2016/0233066 | A1* | 8/2016 | Kovtoun | H01J 49/0045 |

FOREIGN PATENT DOCUMENTS

| | | | | |
|---|---|---|---|---|
| EP | 3486938 | A1 | 5/2019 | |
| WO | WO-2008008634 | A2 * | 1/2008 | H01J 49/4295 |

* cited by examiner

SPACE-TIME BUFFER FOR ION PROCESSING PIPELINES

FIELD

The present disclosure generally relates to the field of mass spectrometry including a space-time buffer for ion processing pipelines.

Introduction

Tandem mass spectrometry, referred to as MS/MS, is a popular and widely-used analytical technique whereby precursor ions derived from a sample are subjected to fragmentation under controlled conditions to produce product ions. The product ion spectra contain information that is useful for structural elucidation and for identification of sample components with high specificity. In a typical MS/MS experiment, a relatively small number of precursor ion species are selected for fragmentation, for example those ion species of greatest abundances or those having mass-to-charge ratios (m/z's) matching values in an inclusion list. There is growing interest in the use of "all-mass" MS/MS, in which all or a substantial subset of the precursor ions are fragmented. All-mass MS/MS yields information-rich spectra and removes the need to select and isolate particular ion species prior to mass analysis.

One of the first commercial steps in this direction is the Bruker trapped ion mobility spectrometry (TIMS) time of flight (TOF) parallel accumulation serial fragmentation (PASEF) device. This instrument improves throughput by about 5×, by storing ions in the TIMS cell and serially releasing them, whereupon they are isolated by a quadrupole mass filter, dissociated to form fragments, and the fragments are analyzed with a TOF. While ions are being serially released by the TIMS, the next bunch of ions is being accumulated in an upstream storage cell to buffer the downstream processes and achieve higher beam utilization. This method represents a significant improvement over the previous generation instrument, but has serious flaws, including that the dynamic range of precursor abundance is quite limited. The limitations arise in part because of the finite capacity of their upstream storage cell, and in part because of the limited dynamic range of the downstream TOF analyzer. From the foregoing, it will be appreciated that a need exists for improved systems and methods for "all-mass" MS/MS.

SUMMARY

In a first aspect, a space-time buffer can include a plurality of discrete trapping regions and a controller. The plurality of discrete trapping regions can be configured to trap ions as individual trapping regions or as combinations of trapping regions. The controller can be configured to combine at least a portion of the plurality of trapping regions into a larger trap region; fill the larger trap region with a plurality of ions; split the larger trap region into individual trapping regions each containing a portion of the plurality of ions; and eject ions from the trapping regions.

In various embodiments of the first aspect, the plurality of discrete trapping regions can include a plurality of pole rod pairs arranged in parallel, each discrete trapping region can be defined by two or more contiguous pole rod pairs. In particular embodiments, the controller can combine at least a portion of the plurality of trapping regions into a larger trap region by applying a high potential to pole rod pairs at the end of the larger trap region and a low potential to the pole rode pairs in the interior of the larger trap region. In particular embodiments, the controller can be configured to split the larger trap region into individual trapping regions by applying a high potential to a subset of the pole rode pairs in the interior of the larger trap region.

In various embodiments of the first aspect, the plurality of discrete trapping regions can include a multipole of segmented electrodes with lenses between the segments, each trapping region can be defined by at least one segment and the adjacent lenses.

In various embodiments of the first aspect, the plurality of discrete trapping regions can include a multipole of segmented electrodes, each discrete trapping region can be defined by three or more contiguous segments. In particular embodiments, the controller can combine at least a portion of the plurality of trapping regions into a larger trap region by applying a high potential to segments at the end of the larger trap region and a low potential to the segments in the interior of the larger trap region. In particular embodiments, the controller can be configured to split the larger trap region into individual trapping regions by applying a high potential to a subset of the segments in the interior of the larger trap region.

In various embodiments of the first aspect, the controller can be further configured to eject the ions sequentially.

In various embodiments of the first aspect, the controller can be further configured to eject the ions simultaneously.

In a second aspect, a method for analyzing components of a sample can include combining at least a portion of a plurality of trapping regions into a larger trap region; filling the larger trap region with a plurality of ions; splitting the larger trap region into individual trapping regions each containing a portion of the plurality of ions; and sequentially ejecting ions from the trapping regions.

In various embodiments of the second aspect, the plurality of discrete trapping regions can include a plurality of pole rod pairs arranged in parallel. Each discrete trapping region can be defined by two or more contiguous pole rod pairs.

In various embodiments of the second aspect, the plurality of discrete trapping regions can include a multipole of segmented electrodes. Each discrete trapping region can be defined by three or more contiguous segments.

In various embodiments of the second aspect, the plurality of discrete trapping regions can include a multipole of segmented electrodes with lenses between the segments. Each trapping region can be defined by at least one segment and the adjacent lenses.

In various embodiments of the second aspect, the method can further include generating ions from a sample using the ion source; and separating ions into a plurality of ion groups using the ion separator.

In various embodiments of the second aspect, the method can further include selecting ions within a mass-to-charge range using the mass filter; and fragmenting ions within the mass-to-charge range using the collision cell.

In various embodiments of the second aspect, the method can further include analyzing the ions using the mass analyzer.

In various embodiments of the second aspect, combining at least a portion of the plurality of trapping regions into a larger trap region can include forming a broad potential well across the portion of the plurality of trapping regions.

In various embodiments of the second aspect, splitting the larger trap region into individual trapping regions can include dividing the broad potential well into a plurality of narrow potential wells.

In various embodiments of the second aspect, ejecting the ions from the trapping regions can occur sequentially.

In various embodiments of the second aspect, ejecting the ions from the trapping regions can occur simultaneously.

In a third aspect, a mass spectrometry system can include an ion source, an ion separator, a space-time buffer, a mass filter, a collision cell, a mass analyzer, and a controller. The ion source can be configured to generate ions from a sample. The ion separator can be configured to separate ions based on a property of the ions. The space-time buffer can include a plurality of discrete trapping regions configured to trap ions as individual trapping regions or as combinations of trapping regions. The mass filter can be configured to select ions within a mass-to-charge range. The collision cell can be configured to fragment ions. The mass analyzer can be configured to determine the mass-to-charge ratio of the fragmented ions. The controller can be configured to generate ions from a sample using the ion source; separate ions into a plurality of ion groups using the ion separator; combine at least a portion of the plurality of trapping regions into a larger trap region; fill the larger trap region with a plurality of ions; split the larger trap region into individual trapping regions each containing a portion of the plurality of ions; eject ions from the trapping regions to the mass filter; select ions within a mass-to-charge range using the mass filter; fragment ions within a mass-to-charge range using the collision cell; and analyze the ions using the mass analyzer.

In various embodiments of the third aspect, the controller can be configured to combine at least a portion of the plurality of trapping regions into a larger trap region by forming a broad potential well across the portion of the plurality of trapping regions.

In various embodiments of the third aspect, the controller can be configured to split the larger trap region into individual trapping regions by dividing the broad potential well into a plurality of narrow potential wells.

In various embodiments of the third aspect, the plurality of discrete trapping regions can include a plurality of pole rod pairs arranged in parallel, each discrete trapping region can be defined by two or more contiguous pole rod pairs.

In various embodiments of the third aspect, the plurality of discrete trapping regions can include a multipole of segmented electrodes, each discrete trapping region can be defined by three or more contiguous segments.

In various embodiments of the third aspect, the plurality of discrete trapping regions can include a multipole of segmented electrodes with lenses between the segments, each trapping region can be defined by at least one segment and the adjacent lenses.

In various embodiments of the third aspect, the system can further include an ion buffer upstream of the ion separator.

In various embodiments of the third aspect, the controller can be further configured to eject the ions sequentially.

In various embodiments of the third aspect, the controller can be further configured to eject the ions simultaneously.

In a fourth aspect, a space-time buffer can include a plurality of discrete trapping regions and a controller. The plurality of discrete trapping regions can be configured to trap ions as individual trapping regions or as combinations of trapping regions. The controller can be configured to combine at least a portion of the plurality of trapping regions into one or more traps; fill each of the trap with a plurality of ions; and eject ions from the traps.

In various embodiments of the fourth aspect, further comprising determining an ion flux and calculating a trap region size based on an ion flux.

DRAWINGS

Figure 2:
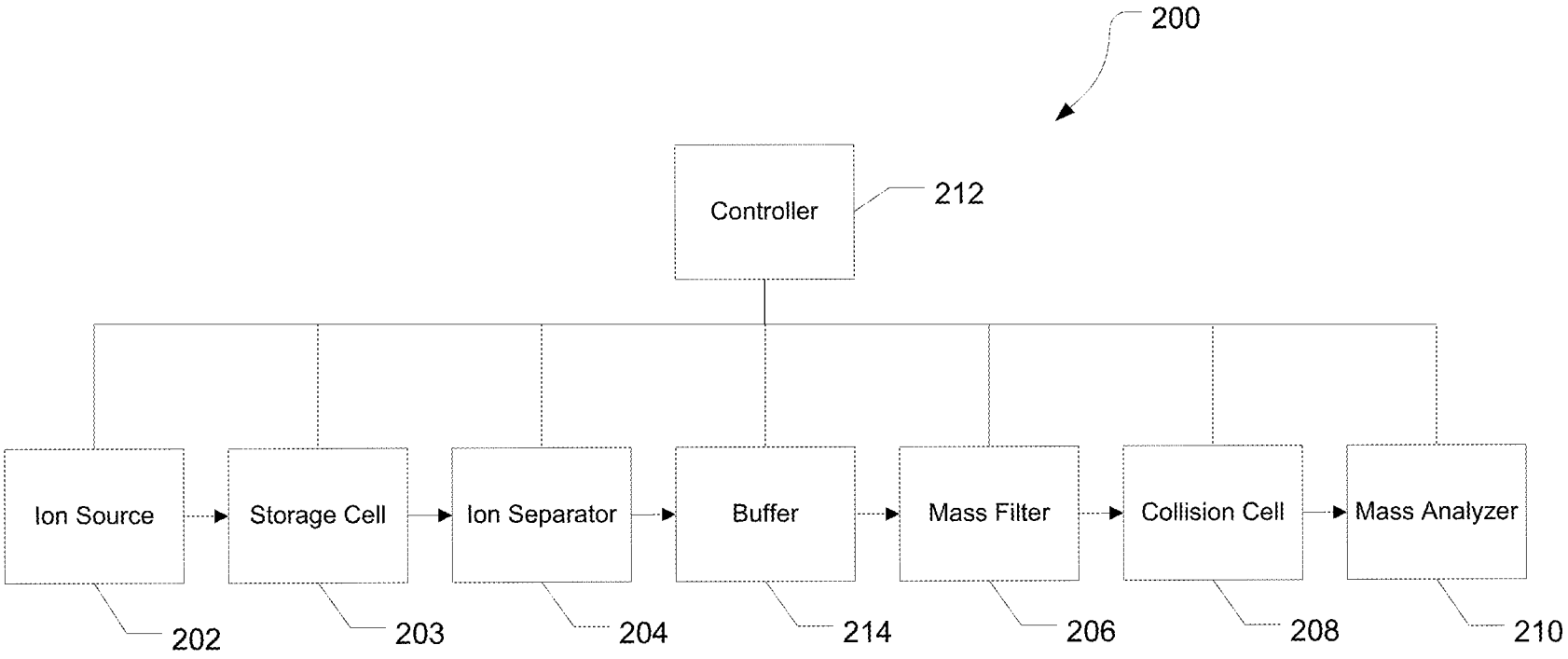

For a more complete understanding of the principles disclosed herein, and the advantages thereof, reference is now made to the following descriptions taken in conjunction with the accompanying drawings, in which:

FIGS. 1 and 2 are block diagram of an exemplary mass spectrometry system, in accordance with various embodiments.

FIGS. 3A, 3B, 4A, 4B, and 5 are diagram illustrating operation of an exemplary space-time buffer, in accordance with various embodiments.

Figure 6:
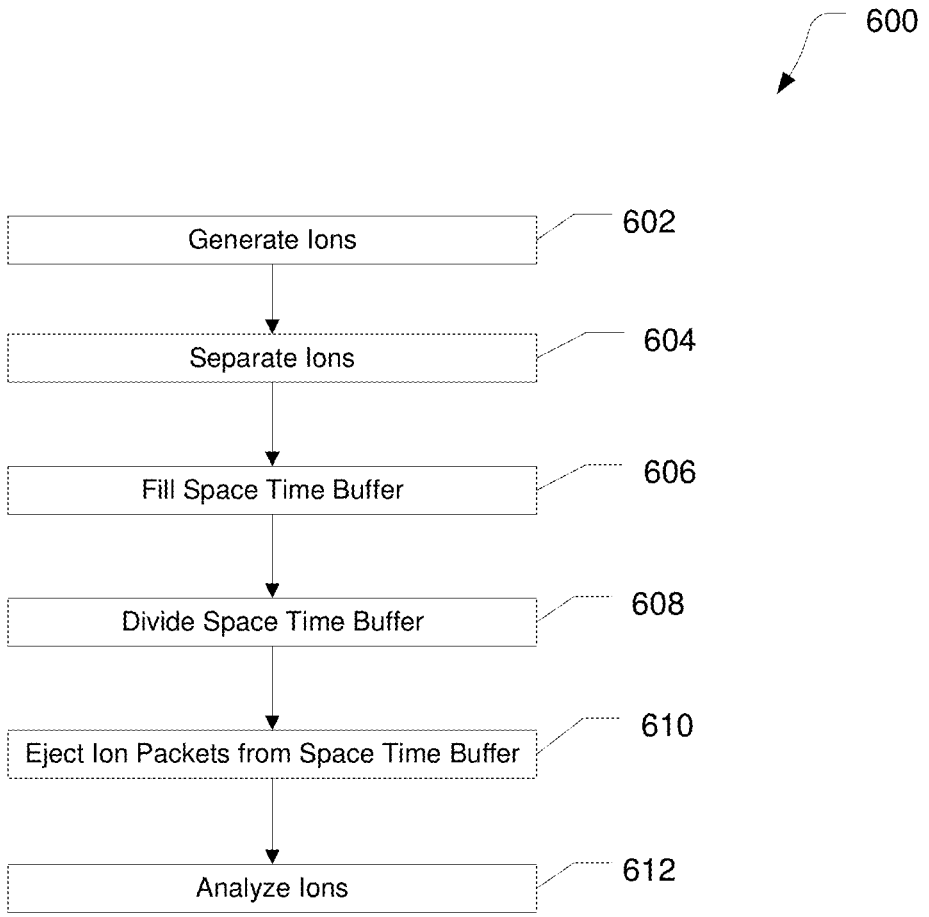

FIG. 6 is a flow diagram illustrating an exemplary method for analyzing ions, in accordance with various embodiments.

Figure 7A:
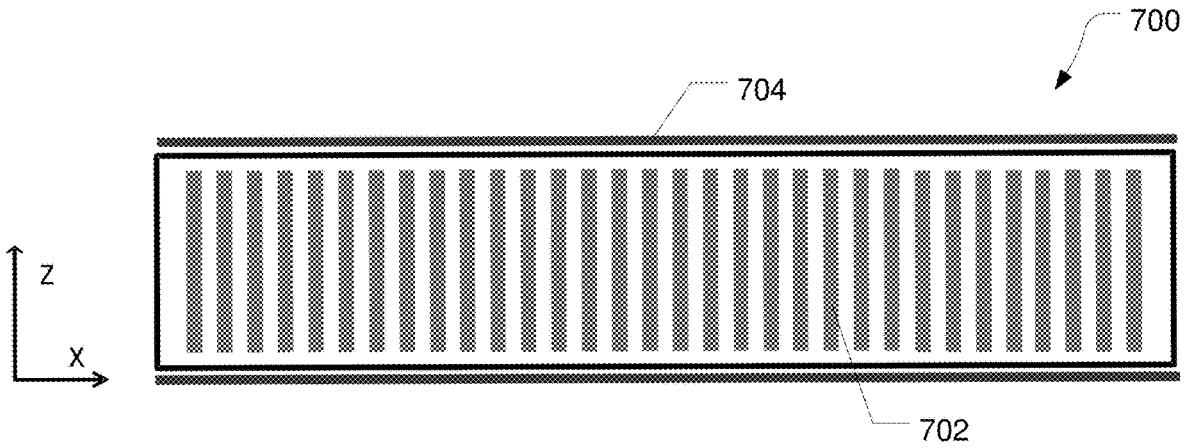
Figure 7B:
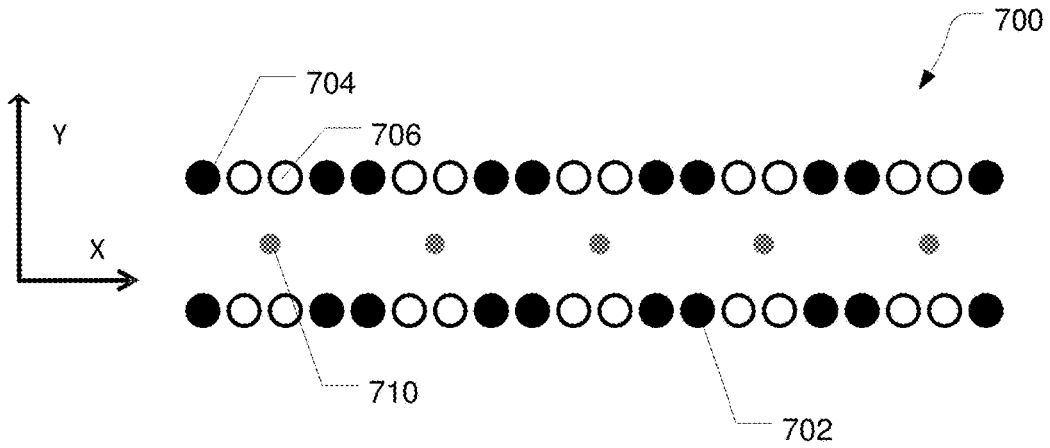
Figure 7C:
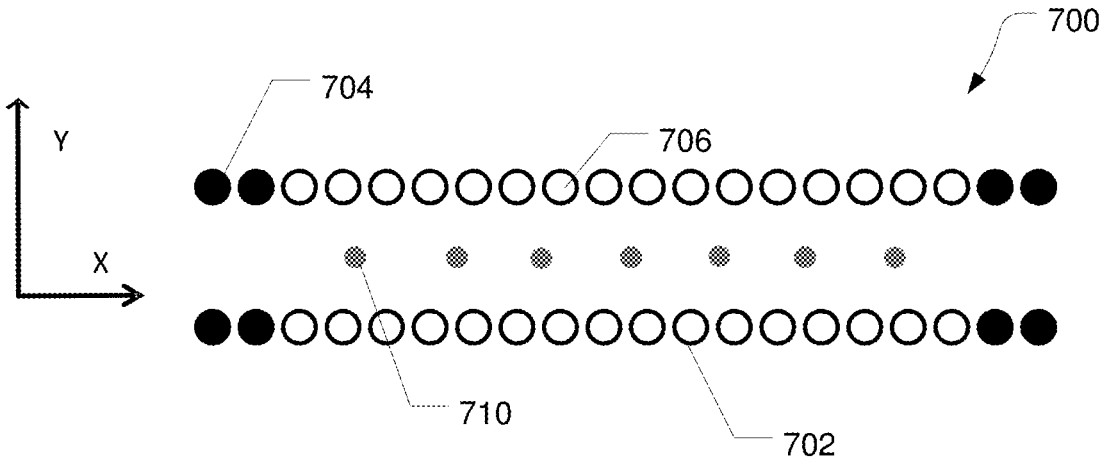

FIGS. 7A, 7B, and 7C are an exemplary space-time buffer, in accordance with various embodiments.

Figure 8:
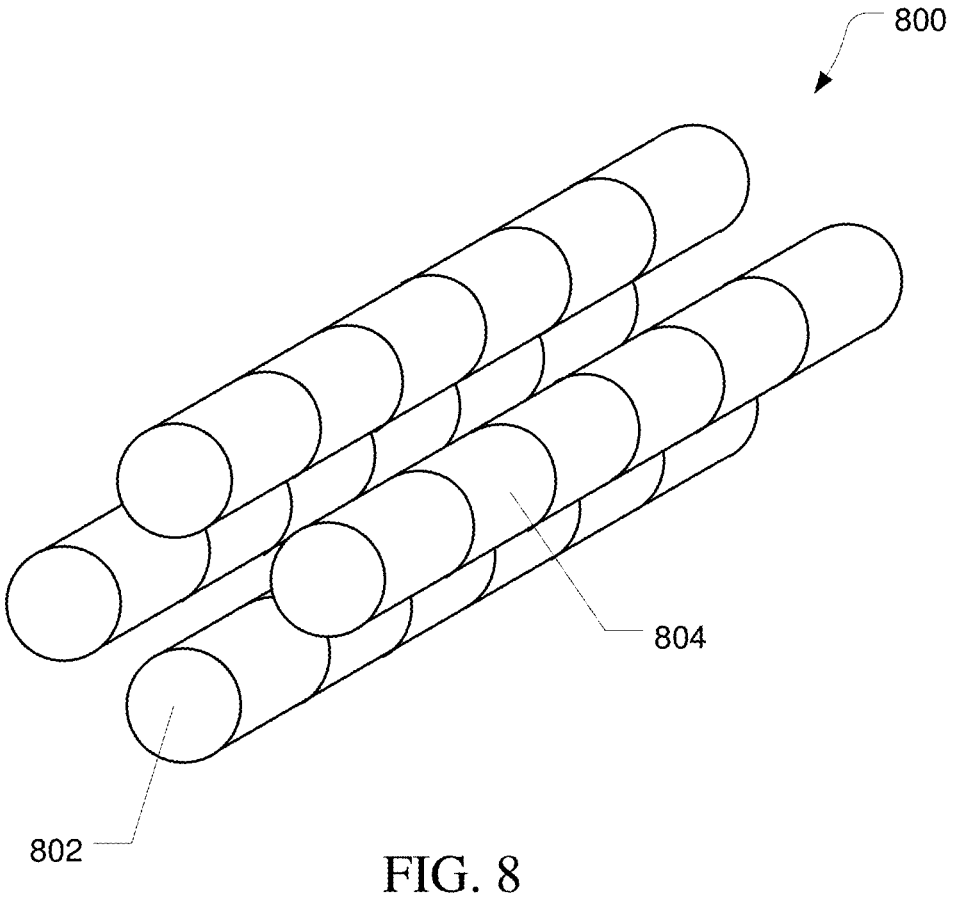

FIG. 8 is an exemplary space-time buffer, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for ion separation are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, an upstream storage cell 103, an ion separator 104, a mass filter 106, a collision cell 108, an ion analyzer 110, and a controller 112.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the upstream storage cell 103 can accumulate ions from the ion source during times when the ion separator 104 is not accepting ions. The ions can then be sent from the upstream storage cell 103 to the ion separator 104 as a packet or higher intensity beam. For example, the upstream storage cell 103 can include an ion trap or other means of containing ions.

In various embodiments, the ion separator 104 can split the ion beam into multiple packets of varying m/z regions or collision cross section (CCS) regions. For example, the ion separator 104 can include a linear ion trap, a trapped ion mobility spectrometry (TIMS), an ion mobility separator (IMS), and the like.

In various embodiments, the mass filter 106 can separate ions based on a mass-to-charge ratio of the ions. For example, the mass filter 106 can include a quadrupole mass filter analyzer, a quadrupole ion trap analyzer, a magnetic sector analyzer, and the like. In various embodiments, the mass filter 106 can also be configured to fragment the ions using collision induced dissociation (CID) electron transfer dissociation (ETD), electron capture dissociation (ECD), photo induced dissociation (PID), surface induced dissociation (SID), and the like, and further separate the fragmented ions based on the mass-to-charge ratio.

In various embodiments, the collision cell 108 can fragment ions selected by the mass filter. In various embodiments, the collision cell 108 can fragment the ions using collision induced dissociation (CID) electron transfer dissociation (ETD), electron capture dissociation (ECD), photo induced dissociation (PID), surface induced dissociation (SID), and the like.

In various embodiments, the mass analyzer 110 can determine a mass-to-charge ratio of the ions. For example, the mass analyzer 110 can include a quadrupole mass filter analyzer, a quadrupole ion trap analyzer, a time-of-flight (TOF) analyzer, an electrostatic trap (e.g., Orbitrap) mass analyzer, Fourier transform ion cyclotron resonance (FT-ICR) mass analyzer, and the like.

In various embodiments, the controller 112 can communicate with the ion source 102, the upstream storage cell 103, the ion separator 104, the mass filter 106, the collision cell 108, and the mass analyzer 110. For example, the controller 112 can configure the ion source or enable/disable the ion source. Additionally, the controller 112 can configure the ion separator and configure the mass filter 106 to select a particular mass range. Further, the controller 112 can adjust the conditions of the collision cell 108 and can configure the mass analyzer.

In various embodiments, the downstream elements can be fast enough to process all the components in all the regions before the upstream elements overflow to prevent the pipeline from stalling. The accumulation time in the upstream storage cell 103 can be set to deliver a population of ions smaller than the capacity of ion separator 104, but also set such that the largest component in the population doesn't saturate the mass analyzer 110. This last consideration in particular severely restricts the dynamic range of components that may be analyzed in the same m/z or CCS region.

Space-Time Buffer

Here we propose a means of dealing with large variations in the flux of the separated m/z or CCS regions so that the downstream elements don't saturate, through the introduction of a new device between the Ion Separator and the Mass Filter. FIG. 2 illustrates a mass spectrometry platform 200 incorporating a space-time buffer 214 between the ion separator 204 and the mass filter 206. Mass spectrometer 200 can include an ion source 202, an upstream storage cell 203, an ion separator 204, a mass filter 206, collision cell 208, mass analyzer 210, and a controller 212, and a space-time buffer 214. In various embodiments, the space-time buffer 214 can be located downstream of the ion separator 204 and upstream of the mass filter 206. In other embodiments, the space-time buffer 214 can be located downstream of the mass filter 206, or even downstream of the collision cell 208. The space-time buffer is configured to spread the ion input in both space and time, releasing packets of ions to downstream devices that are within an intensity acceptable range.

Figure 3A:
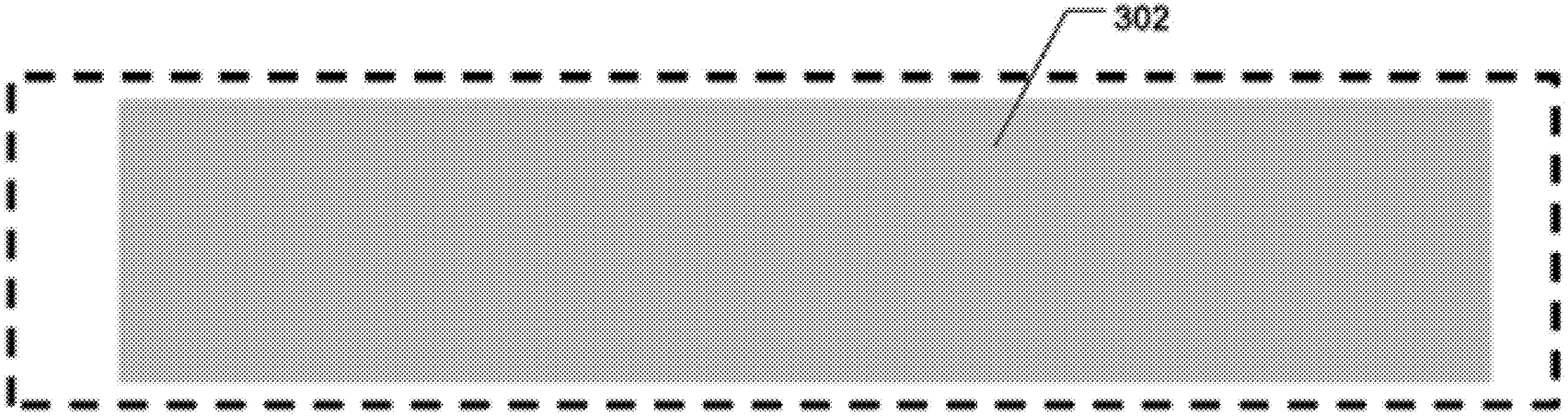
Figure 3B:
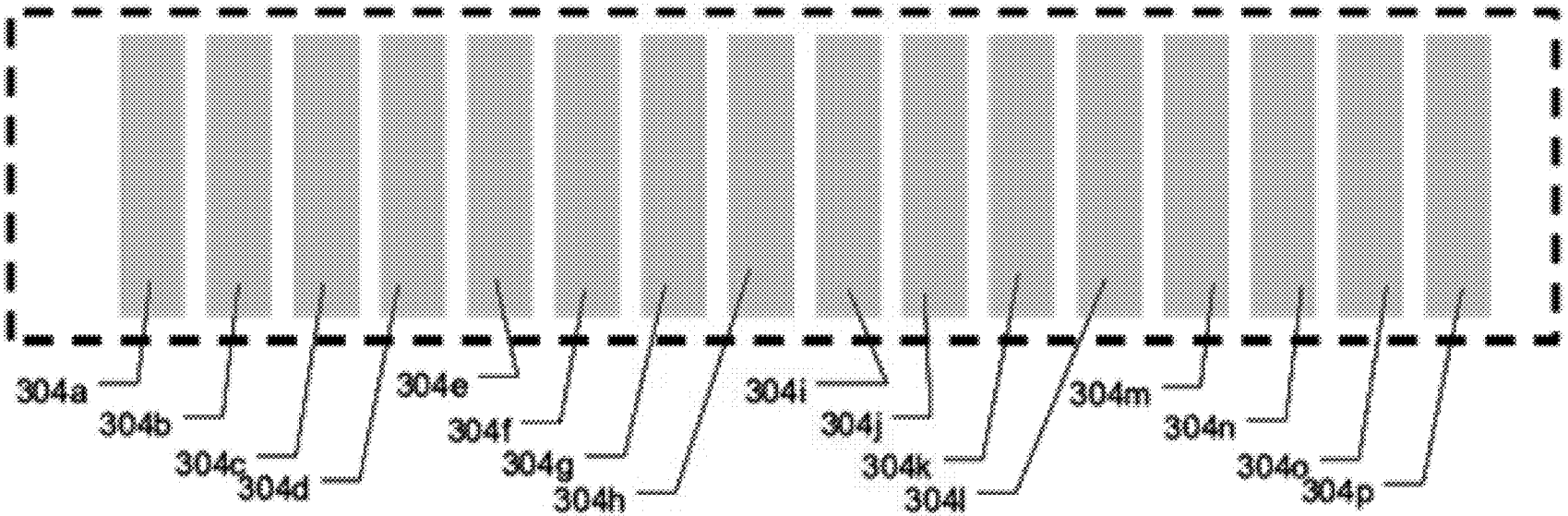

In various embodiments, the space-time buffer 214 can consist of a plurality of discrete trapping regions which can be configured to operate as a large number of smaller traps or smaller numbers of large traps. FIG. 3A shows the space-time buffer 214 configured as a large trapping region where a population of ions entering the device can be allowed to fill the entire volume 302. The total number of ions should be known based on a previous measurement, through any of various methods known in the art. When the ions have equilibrated, a plurality of trapping regions 304*a-p* can be formed inside the device, as illustrated in Figured 3B. The ions in each region can be separated from the others. In various embodiments, each region can preferably contain a number of ions less than or equal to the saturation limit of the downstream devices. Although it is contemplated that a region can contain a number of ions above the saturation limit of a downstream device in certain circumstances. Each trapping region can serially release its payload to the downstream devices.

In various embodiments, each smallest trapping region can have a capacity equal to the saturation range of the downstream elements, making allowances for the expected losses between the Space-Time buffer and the mass analyzer. For example, given the fraction of the component intensity in the m/z or CCS region c, mass filter isolation efficiency q, collision cell fragmentation efficiency f, TOF flight efficiency t, an expected number of fragment ions k, and assuming a uniform distribution of fragment ion abundances, the maximum number of ions reaching the TOF analyzer in any peak can be given by $I_S$ in Equation 1. For a high speed analog TOF analyzer that saturates at $I_S$=1e3 ions in a peak, and given c=0.1, q=0.5, f=0.5, t=0.5, k=10, the target number of ions in a Space-Time cell is $$\frac{1000 \cdot 10}{0.1 \cdot 0.5 \cdot 0.5 \cdot 0.5} = 8e5 \text{ ions.}$$

$$I_0 \cdot c \cdot q \cdot f \cdot t \cdot \frac{1}{k} = I_s \qquad \text{Equation 1}$$

In a first example, there can be a high ion flux. Ions can enter the space-time buffer 214 and can be allowed to spread out as in FIG. 3A. The total number of ions entering the Space-Time buffer should be limited to 16×8e5 ions, by the controlled injection of ions into the upstream Ion Separator 204. The device space-time buffer 214 can now be configured to create the maximum number of trapping regions as in FIG. 3B and can distribute the ions uniformly across the trapping regions. After the trapping regions have been established, each region can be ejected from the Space-Time buffer serially.

Figure 4A:
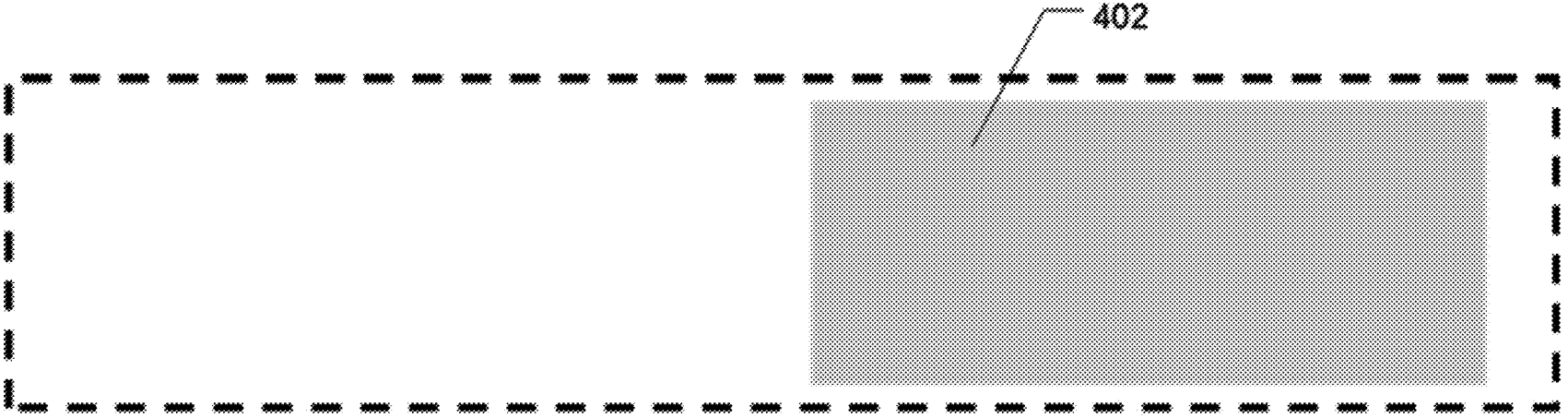
Figure 4B:
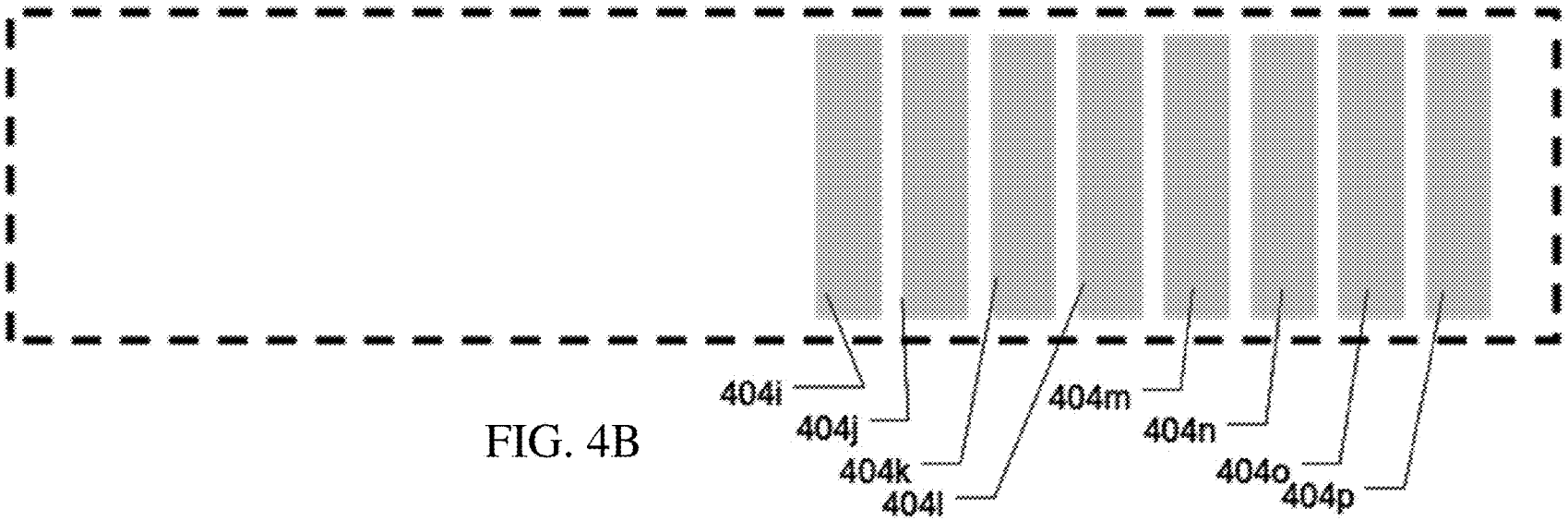
Figure 5:
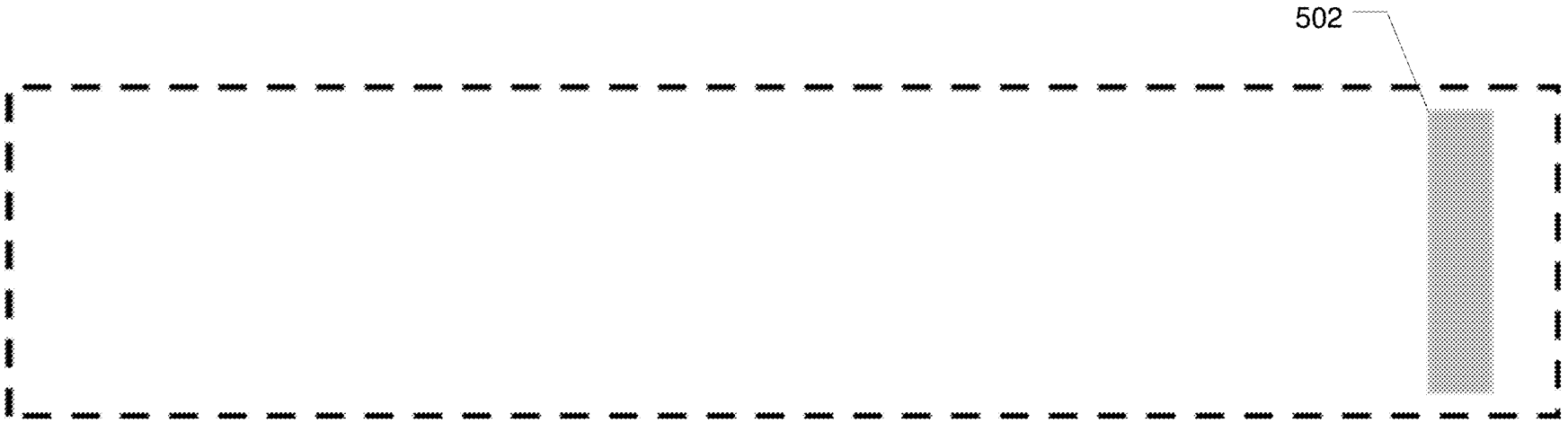

In a second example, there can be a medium ion flux. Ions can be allowed to enter the space-time buffer 214 but can be confined to a trap 402 at the end of the space-time buffer 214, as in FIG. 4A. The space-time buffer 214 can be configured to form an intermediate number of trapping regions 404*i-p* as illustrated in FIG. 4B. Fewer trapping regions are needed because the total number of ions is less. Ions can be confined to traps at the exit side of the device for faster evacuation.

In a third example, there can be a low ion flux. Ions can enter the space-time buffer 214 and can be trapped only to allow the downstream analyzer time to process the previous package of ions, and only one trapping region 502 is ever formed.

The dynamic range of ions emanating from the Ion Separator 204 can be increased by the total number of discrete trapping regions that can be formed in the Space-time buffer 214. The upper limit on the number of bins in the Space-time Buffer 214 can take into account the time needed to process ions in the Ion Separator 204. Ideally, the time required to process a m/z or CSS region in the Ion Separator 204 should equal the time required to process the trapping regions in the Space-time Buffer 214, but this time can scale linearly with the number of formed trapping regions. An ability to modulate the length of time between m/z region releases in the Ion Separator 204, and sufficient buffering capacity upstream of the Ion Separator 204 must be designed into the pipeline. The maximum amount of upstream buffering capacity required can be equivalent to the ions accumulated during N releases from the Space-time Buffer times P m/z or CCS regions released from the ion separator. For example, given P=10, N=16 and TOF analysis time of 2 ms, we need to buffer 320 ms of accumulation time. At an input flux of 1e6 ions/ms, we need a capacity of 3.2e8 ions, which is large, but not so large that we can't contemplate accomplishing this through various means.

To keep the pipeline moving in a case with limited upstream buffering capacity, it would also be possible to process M<N of the formed trapping regions and eliminate the ions in the remaining trapping regions of the device. This could keep the pipeline from stalling, but still accomplish the goal of modulating the flux of ions from the Ion Separator to the appropriate level required by the downstream devices.

FIG. 6 is a flow diagram illustrating a method of performing an all mass MS/MS analysis. At 602, the ions can be produced, such as from a sample, in an ion source. At 604, the ions can be separated in an ion separator. The ions can be separated based on m/z, collision cross section, or other known ion separation techniques. At 606, the ions can enter the space-time buffer and to fill the space-time buffer. Once the ions are held within the space-time buffer, the space-time buffer can be divided into a plurality of smaller trapping regions, as indicated at 608. At 610, the ions can be sequentially ejected from the space-time buffer, and at 612, the ions can be analyzed. Analysis can include mass filtering the ions, fragmentation, and mass analysis.

In various embodiments, the trapping regions can be configured to an appropriate size based on the ion flux and the trapping regions can be filled sequentially rather than filling a larger trapping region and then dividing into smaller regions.

FIGS. 7A and 7B illustrate an exemplary embodiment of a space-time buffer 700. Space-time buffer 700 can include a plurality of pole rod pairs 702 arranged parallel to one another along a length (x-axis) of the Space-time buffer 700. In various embodiments, each pole rod pair 702 can consist of 2 pole rods separated in the direction orthogonal to the plane of the FIG. 7A. Additionally, the Space-time buffer 700 may include guard electrodes 704 to confine the ions. In various embodiments, a high potential can be placed on the guard electrodes 704 to confine the ions in the z dimension. Alternatively, the electrodes 702 can be segmented and a higher DC potential can be provided by the end segments to confine the ions.

The electrodes 702 can have alternating phases of an RF voltage for ion confinement. The trapping regions may be configured to trap ions, or to allow communication between traps through modulation of AC or DC voltages between trapping regions. FIG. 7B illustrates a pattern of voltages that can be used to separate trapping regions with filled circles 704 representing a higher potential and open circles 706 representing a lower potential. In various embodiments, the higher potentials can be more positive for positive ions and more negative for negative ions than the lower potentials. Ions 710 can be confined in the potential well formed by the high and low voltages applied to the electrodes. In various embodiments, the size and number of trapping regions can be changed by altering the potentials on the electrodes 702. FIG. 7C shows a pattern of voltages that can be used to form one large trapping region with a broad potential well formed with high potentials 704 placed on electrodes at the ends of the space-time buffer 700 and low potentials 706 placed on electrodes in the interior region of the space-time buffer 700.

In various embodiments, the separated ions can be transferred from the ion separator to the Space-time buffer 700 by injecting the ions into the Space-time buffer 700 from the end and orthogonal to the primary (longitudinal) axes of the pole rod pairs (in the x direction). In other embodiments, the ions can be injected into the space-time buffer 700 parallel to the primary (longitudinal) axes of the pole rod pairs (in the z direction). The space-time buffer can be reconfigured from a larger trapping region to a plurality of smaller trapping regions and the ions can then be sequentially transferred within and between the trapping regions along the length of the Space-time buffer 700 (x direction, perpendicular to the primary axes of the pole rods) through manipulation of the electrical potentials of the pole rods. Additionally, a potential well can be moved along the space-time buffer 700, moving ions packets along the device. The ions packets can be ejected in the x direction from the Space-time buffer 700 into another device, such as a mass filter, by advancing the voltage pattern until the trailing high potential forces the ions from the end of the Space-time buffer 700.

In various embodiments, manipulation of the AC or DC voltages can be used to move ions along the space-time buffer and eject the ions from the end of the space-time buffer 700. U.S. Pat. No. 9,330,894, which is hereby fully incorporated by reference herein, discloses a method that can be used to move and eject the ions from the space-time buffer 700. Other techniques are also known in the art.

In other various embodiments, the ions can be ejected orthogonally from the side of the space-time buffer 700 (z direction), such as into an array of ion storage cells or a plurality of mass filters, collisions cells, and mass analyzers. In alternate embodiments, once the ions are separated into smaller trapping regions, ions may be ejected from the space-time buffer 700 by placing a high potential on one guard electrode 704 and a low potential on the other guard electrode 704 and driving the ions out of the Space-time buffer 700 in the z direction (parallel to the length of the pole rods). Alternatively, ions may be ejected from the Space-time buffer 700 by using segmented rods with a gradient potential applied to drive the ions out of the Space-time buffer 700.

In various embodiments, the space-time buffer 700 can be filled with a damping or cooling gas. The damping gas can include He, N2, Ar, air, or the like. In various embodiments, the gas can be at a pressure in a range of about 0.1 mtorr to about 100 mtorr, such as in a range of about 1 mtorr to about 30 mtorr. In other embodiments, the space-time buffer can be operated at a pressure similar to the pressure of the ion separator.

FIG. 8 illustrates another exemplary embodiment of a space-time buffer 800. Space-time buffer 800 include a plurality of segmented electrodes 802 arranged about a central axis. The electrodes 802 can be arranged to form a quadrupole, as illustrated in FIG. 8. Alternatively, higher order multipoles can be formed using additional electrodes. The electrodes 802 can have alternating phases of an RF voltage on adjacent multipole rods to confine ions close to the central axis. The segments 804 of the electrodes 802 can be configured to trap ions, or to allow communication between traps through modulation of AC or DC voltages applied to the segments 804. Analogous to the discussion regarding FIGS. 7A, 7B, and 7C, a large potential well can be formed by applying a high potential to the end segments 804 of Space-time buffer 800 and low potential to the interior segments. The large trapping region can be split into a plurality of smaller trapping regions by applying high potentials to a portion of the interior segments. Ions trapped within the smaller regions can be sequentially ejected from Space-time buffer 800 by moving the potential wells along the space-time buffer 800, forcing ions from the end.

In various embodiments, the segments 804 can be separated by lenses. A potential well can be formed by placing a high potential on the lenses at the end of the trapping region and low potentials on the lenses in the interior of the trapping region for trapping regions spanning more than one segment 804.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A mass spectrometry system comprising:

an ion source configured to generate ions from a sample;

an ion separator configured to separate ions based on a property of the ions;

a space-time buffer including a plurality of discrete trapping regions configured to trap ions as individual trapping regions or as combinations of trapping regions;

a mass filter configured to select ions within a mass-to-charge range;

a collision cell configured to fragment ions;

a mass analyzer configured to determine the mass-to-charge ratio of the fragmented ions; and a controller configured to:

generate ions from a sample using the ion source;

separate ions into a plurality of ion groups using the ion separator;

combine at least a portion of the plurality of trapping regions into a larger trap region;

fill the larger trap region with a plurality of ions;

split the larger trap region into individual trapping regions each containing a portion of the plurality of ions;

eject ions from the trapping regions to the mass filter;

select ions within a mass-to-charge range using the mass filter;

fragment ions within a mass-to-charge range using the collision cell; and analyze the ions using the mass analyzer.

2. The mass spectrometry system of claim 1, wherein the controller is configured to combine at least a portion of the plurality of trapping regions into a larger trap region by forming a broad potential well across the portion of the plurality of trapping regions.

3. The mass spectrometry system of claim 1, wherein the controller is configured to split the larger trap region into individual trapping regions by dividing the broad potential well into a plurality of narrow potential wells.

4. The mass spectrometry system of claim 1, wherein the plurality of discrete trapping regions includes a plurality of pole rod pairs arranged in parallel, each discrete trapping region defined by two or more contiguous pole rod pairs.

5. The mass spectrometry system of claim 4 wherein the controller combines at least a portion of the plurality of trapping regions into a larger trap region by applying a high potential to pole rod pairs at the end of the larger trap region and a low potential to the pole rode pairs in the interior of the larger trap region.

6. The mass spectrometry system of claim 5 wherein the controller is configured to split the larger trap region into individual trapping regions by applying a high potential to a subset of the pole rode pairs in the interior of the larger trap region.

7. The mass spectrometry system of claim 1, wherein the plurality of discrete trapping regions includes a multipole of segmented electrodes, each discrete trapping region defined by three or more contiguous segments.

8. The mass spectrometry system of claim 7 wherein the controller is configured to combine at least a portion of the plurality of trapping regions into a larger trap region by applying a high potential to segments at the end of the larger trap region and a low potential to the segments in the interior of the larger trap region.

9. The mass spectrometry system of claim 8 wherein the controller is configured to split the larger trap region into individual trapping regions by applying a high potential to a subset of the segments in the interior of the larger trap region.

10. The mass spectrometry system of claim 1, wherein the plurality of discrete trapping regions includes a multipole of segmented electrodes with lenses between the segments, each trapping region defined by at least one segment.

11. The mass spectrometry system of claim 1, further comprising an ion buffer upstream of the ion separator.

12. The mass spectrometry system of claim 1, wherein the controller is further configured to eject the ions sequentially.

13. The mass spectrometry system of claim 1, wherein the controller is further configured to eject the ions simultaneously.

14. A space-time buffer comprising:

a plurality of discrete trapping regions configured to trap ions as individual trapping regions or as combinations of trapping regions; and a controller configured to:

determine an ion flux and calculate a trap region size based on an ion flux;

combine at least a portion of the plurality of trapping regions into one or more traps according to the determined trap region size;

fill each of the trap with a plurality of ions; and eject ions from the traps.

* * * * *